United States Patent [19]

Graebe

[11] Patent Number: 4,541,136

[45] Date of Patent: Sep. 17, 1985

[54] MULTICELL CUSHION

[76] Inventor: Robert H. Graebe, 4 Signal Hill Blvd., Belleville, Ill. 62223

[21] Appl. No.: 528,616

[22] Filed: Sep. 1, 1983

[51] Int. Cl.[4] ..... A47C 27/08

[52] U.S. Cl. ..... 5/456; 5/455

[58] Field of Search ..... 5/455, 456, 453, 454, 5/470, 471, 441, 490, 482; 297/DIG. 5

[56] References Cited

U.S. PATENT DOCUMENTS

| | | | |
|---|---|---|---|
| 3,605,145 | 9/1971 | Graebe | 5/456 |
| 3,870,450 | 3/1975 | Graebe | 425/269 |
| 4,005,236 | 1/1977 | Graebe | 5/455 |
| 4,279,044 | 7/1981 | Douglas | 5/455 |
| 4,422,194 | 12/1983 | Viesturs et al. | 5/455 |

*Primary Examiner*—Alexander Grosz

*Attorney, Agent, or Firm*—Gravely, Lieder & Woodruff; Gravely, Lieder & WWoodruff

[57] ABSTRACT

An inflatable air cushion has a base and air cells arranged in rows upon and projecting away from the base, with the outer ends of the air cells forming a supporting surface. The base and air cells are formed from a flexible elastomeric material and are in communication through the base, so that when some of the air cells are deflected by a supported load, all the air cells nevertheless remain at the same internal pressure. Thus, those air cells that are against the load exert equal forces on the load, irrespective of the amount of deflection. Adjacent air cells when inflated are adapted to contact each other along their sides so as to provide a generally continuous supporting surface. To this end, each air cell when deflated has four fins arranged symmetrically about its axis, with each fin having spaced apart side walls. The side walls of adjacent fins are connected near the center of the air cell to provide depressions that open out of the air cells. Between each depression and the base is an inclined wall, and the four inclined walls serve to provide the air cell with a square pedestal. When the air cells are pressurized, the side walls of their fins and the inclined pedestal walls move outwardly and contact the opposite side walls and pedestal walls on adjacent air cells, so the load supporting surface is generally uniform. The air cells and connecting portions of the base are formed on a mandrel which is dipped in a latex solution.

19 Claims, 10 Drawing Figures

MULTICELL CUSHION

BACKGROUND OF THE INVENTION

This invention relates in general to cushioning devices and more particularly to cushions having a multiplicity of inflatable cells.

Conventional cushioning devices for supporting the human body, such as the typical mattress, seat cushion or padded back rest, do not distribute the weight of the supported body evenly over the area of the body that is in contact with the cushioning device. For example, in the case of a mattress the buttocks or hips, and likewise the shoulders, sink further into the mattress than the lumbar region of the back. Since most conventional cushioning devices exert a supporting force that is proportional to the amount they are deflected, those portions of the body which sink deepest into the cushioning device experience a resisting force per unit area that is considerably greater than those body portions that deflect the cushioning device only slightly. For those individuals who are confined to beds or wheel chairs for extended periods of time the unequal distribution of supporting forces can lead to extreme discomfort and can even be debilitating in the sense that bed sores often develop at the skin areas where the supporting force is greatest.

While cushions which derive their cushioning properties from inner springs or foam material are quite common and inexpensive to manufacture, they suffer the inability to distribute loads or restoring forces evenly. On the other hand, some very specialized cushions are available which distribute the supporting forces more evenly and indeed generally uniformly over the entire supported area. These cushions employ a series of air cells which are extended generally perpendicular from a base and are, therefore, oriented generally perpendicular to the contacting surface of the body that they support. Moreover, all of the cells are interconnected and, therefore, exist at the same internal pressure irrespective of the extent of deflection. Since the ends of the cells actually contact the supported body, it is desirable to have the cells arranged quite closely for this enables the ends of the cells to resemble a generally continuous surface. Perhaps the most refined air cell cushions currently available are disclosed in U.S. Pat. Nos. 3,870,450 and 4,005,236. The air cells of these cushions are molded in a fluted configuration, each with seven or eight fins, so that when the cells are inflated they will expand laterally into contact with each other and their ends will collectively form a generally uniform supporting surface.

While cushions of the type disclosed in U.S. Pat. Nos. 3,870,450 and 4,005,236 provide uniform load supporting characteristics, they are difficult and expensive to manufacture, owing primarily to the large number of fins in each cell. These fins on occasion prevent the latex from distributing uniformly over forms used in the dipping operation by which the cushions are made, and this results in a high rejection rate. The problem seems to reside primarily in the small form radii created by the numerous fins, for air bubbles tend to collect in the radii and cause discontinuities in the latex film that builds up on the form. Also, the numerous fins impede stripping the dipped parts from the forms. Also, the numerous fins on each mold produce an overall cell configuration which tends to experience its greatest wear on the top of the air cell, as well as significant wear along its sides where it contacts other air cells. Furthermore, the cushion, by reason of its multifluted cells, is difficult to clean.

SUMMARY OF THE INVENTION

One of the principal objects of the present invention is to provide a cushion which exerts its supporting forces on a supported body generally uniformly through a multiplicity of interconnected air cells. Another object is to provide a cushion of the type stated in which the air cells are easily formed in a simple dipping operation. A further object is to provide a cushion of the type stated in which the air cells are arranged in rows both longitudinally and transversely in the cushion. An additional object is to provide a cushion of the type stated which is easily cleaned. Still another object is to provide a cushion of the type stated which is durable. Yet another object is to provide a dipping form for producing a cushion of the type stated, with the form having relatively large radii which deter air bubbles from collecting when the form is dipped. These and other objects and advantages will become apparent hereinafter.

DESCRIPTION OF THE DRAWINGS

In the accompanying drawings which form part of the specification and wherein like numerals and letters refer to like parts wherever they occur.

DETAILED DESCRIPTION

Figure 1:
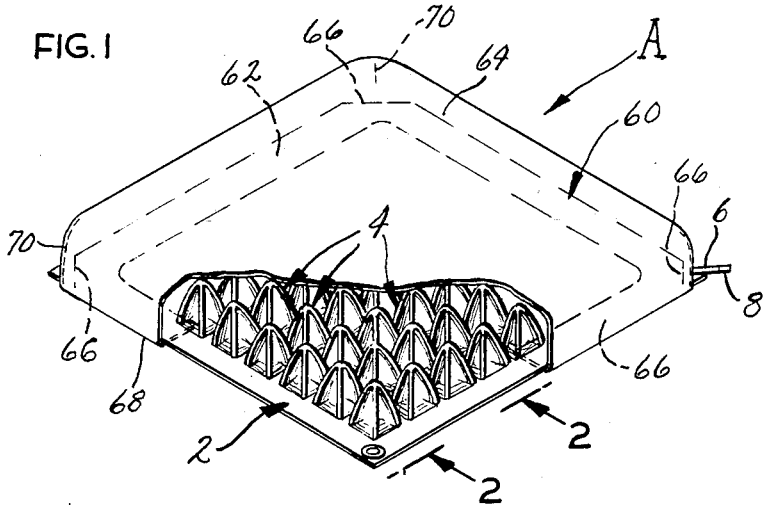
FIG. 1 is a perspective view of a cushion constructed in accordance with and embodying the present invention, the cover of the cushion being broken away to show the cells in a deflated condition.

Referring now to the drawings, a cushion A (FIG. 1) basically includes a base 2, and a multiplicity of air cells 4 projecting from the base 2 generally parallel to each other. The air cells 4 are the same size and configuration and are arranged in transverse and longitudinal rows to form an array of rectangular configuration. One or more of the air cells at a corner of the cushion A is provided with a tube 6 through which air may be introduced into the cushion for inflating its air cells 4. The tube 6, in turn, contains a manually operated valve 8. Within the base 2 adjacent air cells 4 are connected in the sense that their interiors are in communication with each other, so that when the air cells 4 are inflated through the tube 6 all will exist at the same pressure. Similarly, should a load deflect some of the air cells 4 more than the others, the pressure within all of the air cells 4 will nevertheless equalize. Thus, the cushion A will exert a generally uniform force, or more accurately pressure, on the surface area of any body supported on it, even though that body may be of complex and irregular contours and deflect some of the air cells 4 more than others. By reason of these characteristics, the cushion A is ideally suited for use as a mattress, a portion of a mattress, a seat cushion, or a back rest.

Figure 2:
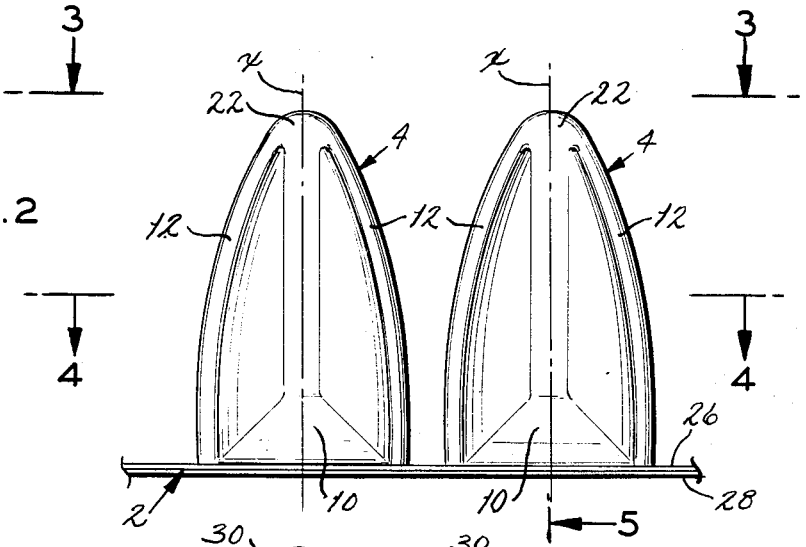
FIG. 2 is an elevational view of the cushion taken along line 2—2 of FIG. 1.
Figure 3:
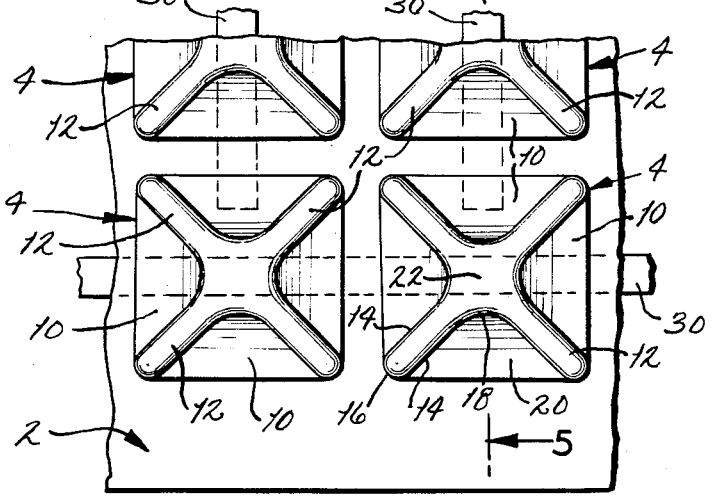
FIG. 3 is a plan view taken along line 3—3 of FIG. 2.
Figure 4:
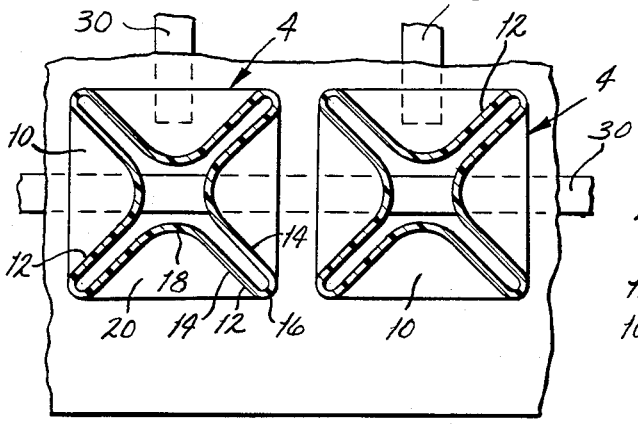
FIG. 4 is a sectional view taken along line 4—4 of FIG. 2.
Figure 5:
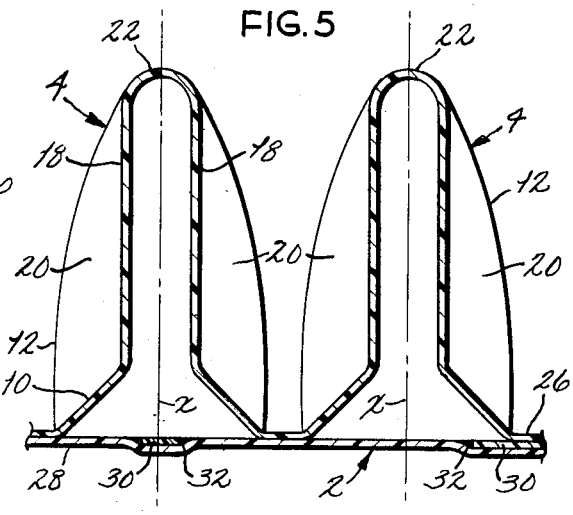
FIG. 5 is a sectional view taken along line 5—5 of FIG. 3.

Each air cell 4 is symmetrical about a center axis X that is perpendicular to the base 2 and in its deflated configuration, that is the configuration in which is it formed, includes (FIGS. 2–5) a pedestal 10 and four projections or fins 12 which extend upwardly from the pedestal 10, the fins 12 being arranged at 90° intervals around the axis X. The pedestal 10 is pyramidal and as such has four sloping side walls (FIG. 5). Where it merges into the base 2 it is square (FIGS. 3 & 4). The fins 12 extend out to the corners of the pyramidal pedestal 10, and each fin 12 has spaced apart side walls 14 which are parallel and along the outside of the fin 12 these walls 14 are connected by a convex edge wall 16. The side walls 14 of adjacent fins 12 merge at concave connecting walls 18. Thus, each air cell 4 has a depression 20 opening out of each of its four sides, there being a different depression 20 above each of the four inclined walls that comprise the pedestal 10. The connecting walls 18 extend upwardly from the upper end of the pedestal 10 and are straight throughout most of their length. The convex edge walls 16, on the other hand, extend upwardly from the corners of the pedestal 10 and thus originate at the base 2. For much of their length the convex edge walls 16 are straight, but near their upper ends they, in contrast to the concave walls 18, curve inwardly toward the axis X. At the upper end of the air cell 4 the convex edge walls 16, the side walls 16 and the connecting walls 18 all merge into a dome 22 which is the top of the air cell 4 (FIGS. 2 & 5).

The air cells 4 are arranged on the base 2 in longitudinal and transverse rows (FIG. 1) and the margins of the pedestals 10 for these cells lie parallel to the rows. Thus, for each air cell 4 two of the margins on its square pedestal 10 are parallel to the longitudinal rows and two are parallel to the transverse rows. The fins 12, being extended to the corners of the pedestals 10, are of course oriented at 45° with respect to the rows. The spacing between the longitudinal rows and the transverse rows is equal.

The filling tube 6 extends outwardly from the fin 12 on an air cell 4 at one of the corners of the cushion A, so that it is easily accessible for inflating the air cells 4. The tube 6 contains the valve 8.

The base 2 consists of an upper sheet 26 and a lower sheet 28 (FIGS. 2 & 5) which are cemented together between the rows of air cells 4 and also along the periphery of the cushion A. The upper sheet 26 is formed integral with the air cells 4 and is therefore interrupted by the pedestals 10 for the air cells 4. Thus, viewed from beneath, the upper sheet 26 has a plurality of square pockets which represent openings into the air cells 4. The lower sheet 28, on the other hand, is continuous and closes these openings.

In addition, the base 2 contains communicating strips 30 which extend along each of the longitudinal rows of air cells 4 and also along the two endmost of the transverse rows. The strips 30 are centered with respect to the rows along which they extend, and they prevent the upper and lower sheets 26 and 28 of the base 2 from bonding together where they lie. As such, they provide small connecting ducts or channels 32 between the individual air cells 4 along the rows in which they lie, and it is through these channels that adjacent air cells 4 in the longitudinal rows and in the endmost transverse rows communicate. The channels 32 do not collapse, and the communication that they provide is controlled in that a restricted flow rate between cells 4 is provided. The communicating strips 30 terminate at the endmost air cells 4 in their respective rows and do not extend out into the peripheral region that surrounds the array of air cells 4. Here the two sheets 26 and 28 are bonded firmly together, preferably by a rubber cement, to form an air-tight seal along the periphery of the cushion A. The bonds in the spaces between the rows of air cells 4 do not isolate adjacent air cells 4, but instead prevent the two sheets 26 and 28 from separating when the cushion A is inflated, and thus these bonds serve to maintain the base 2 flat when the cushion A is inflated.

Figure 8:
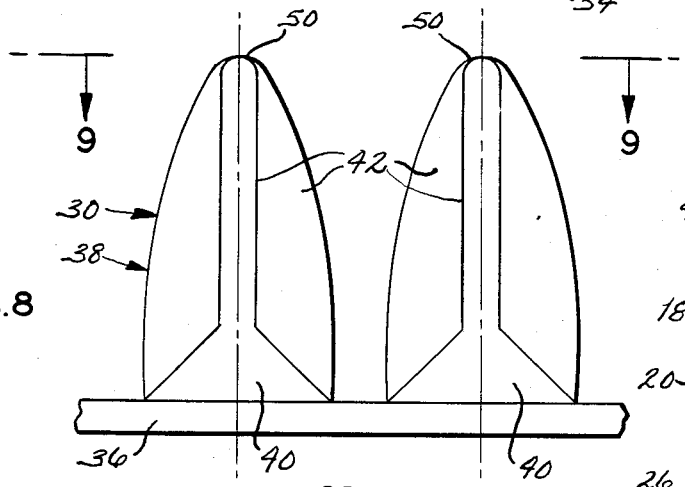
FIG. 8 is an elevational view of a dipping form on which the air cells are formed.
Figure 9:
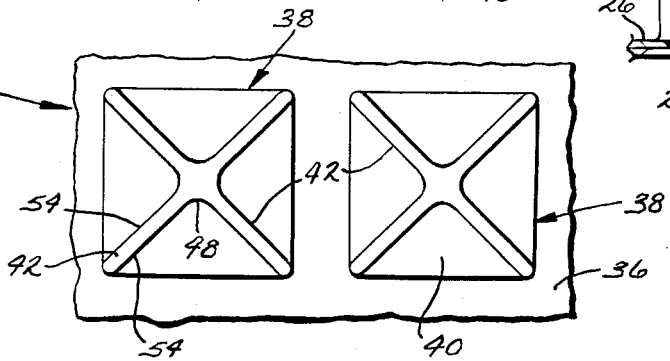
FIG. 9 is a plan view of the dipping form taken along line 9—9 of FIG. 8.

The air cells 4 together with the upper sheet 26 of the base 2, all of which are integral, are formed by repeatedly dipping a form 34 (FIGS. 8 & 9) in a latex bath, and with each dipping more latex adheres to the form 34. The dipping is repeated until the latex on the form 34 reaches the desired thickness, whereupon the latex material that has accumulated on the form 34 is stripped from the mold 34. The resulting shape is the air cells 4 and the upper sheet 26 of the base 2, with the former projecting from the latter.

The dipping form 34 includes (FIGS. 8 & 9) a flat plate 36 and mandrels 38 arranged in longitudinal and transverse rows on the plate 36. The mandrels 38 correspond in configuration and position to the air cells 4, and thus each has a pyramidal pedestal 40, fins 42, flat side surfaces 44 and convex edge surfaces 46 along the fins 42, concave connecting surfaces 48 between the fins, and a dome 50. One of the corner mandrels 38 also has a cylindrical boss 52 projected laterally from one of the fins 42, and it is about this boss that the filling tube 6 is formed. The form 34 is dipped into a latex bath with its plate 36 oriented at about 45°, allowed to remain for a minute or two, and then withdrawn. Since the concave surfaces 48 between the fins 42 on the mandrels 38 have relatively large radii, air does not tend to collect at these locations. Smaller radii, on the other hand, are more likely to trap air in the form of bubbles which remain during the dipping. These bubbles result in a weakness or perhaps a void at the radius, and the resulting air cells are therefore more likely to leak. The inclined surfaces of the pedestal 10 also serve to prevent entrapment of air, since they eliminate deep pockets within the form 34.

The cushion A is assembled by laying the upper sheet 26 over a support plate containing apertures which are spaced to accommodate the air cells 4, with the air cells 4 projecting downwardly through the apertures. This presents the normal bottom of the upper sheet 26 upwardly. Then a rubber cement or other bonding agent is applied to the exposed surface of the upper sheet 26. Next the communication strips 30 are laid over the inverted upper sheet 26, care being exercised to center them with respect to the rows of air cells 4. However, no rubber cement is applied to the strips 30.

In addition one surface of the lower sheet 28 is coated with a rubber cement or other bonding agent. Then with the upper sheet 26 and air cells 4 supported on the apertured plate, the lower sheet 28 is inverted, aligned with the upper sheet 26 on the apertured plate, and then forced tightly against the upper sheet 26. The rubber cement or bonding agent on the two sheets 26 and 28 bonds, joining the two sheets tightly together, except in the regions of the strips 30 where the small communicating channels 32 exist. This completes the base 2.

Finally the joined together sheets 26 and 28 and the integrally formed air cells 4 are removed from the apertured plate and the base 2 is trimmed.

Figure 6:
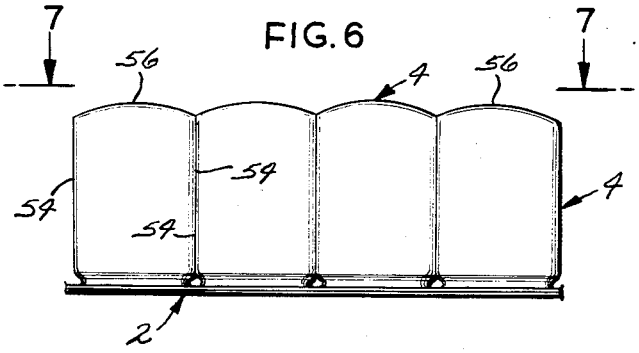
FIG. 6 is an elevational view of the cushion with the air cells inflated.
Figure 7:
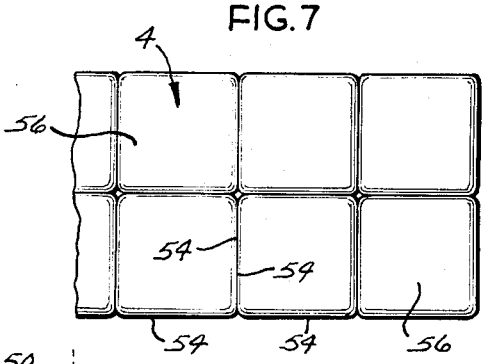
FIG. 7 is a plan view of the cushion taken along line 7—7 of FIG. 6 and likewise showing the air cells inflated.

When the valve 8 in the filling tube 6 is open, the air cells 4 assume the configuration in which they are molded, that is the pedestal 10, the fins 12 and the depressions 20 are all distinctly present. However, when the cushion A is inflated, as it must be in order to be used, the side walls 14 of the fins 12, as well as the concave walls 18 between the fins 12 and the inclined walls of the pedestal 10 move outwardly, and each air cell 4 assumes a somewhat square cross-sectional configuration (FIGS. 6 & 7). In so doing, the side walls 14 of the fins 12 and the concave walls 18 lose their identity and become part of a flat side wall 54, and the depressions 20 are no longer present. Indeed, the flat side walls 54 formed by the displaced fin walls 14 and the concave connecting walls 18 contact their counterparts which they face on the adjacent air cells 14, notwithstanding the spacing that formerly existed between the rows of air cells 4. The additional surface areas afforded by the fins 12 permits adjacent air cells 4 to expand laterally into the voids that originally separated them, and here the air cells 4 contact each other. The location of the fins 12 at the corners of the air cells 4 together with the arrangement of the air cells 4 in rows with their pedestals 10 marginally aligned permits the air cells 4 to retain the square configuration when inflated and, indeed, permits them to occupy substantially the entire area within the confines of the rectangular array, so that no voids exist in that array, even at the corners of the air cells 4. Thus, the domes 22 together with the curved portions of the arcuate edge walls 16 for the fins 12 and the adjacent portions of the fin side walls 14 form enlarged dome-shaped ends 56 which are relatively flat and bear against the supported body. Since the air cells 4 when inflated are packed so closely together, their dome-shaped ends 56 collectively form a surface that is generally continous across the array. It is this surface on which the supported body rests.

To prepare the cushion A for use, air may be pumped into it until it is somewhat over inflated. Then the pump is detached from the filling tube 6 and the valve 8 in that tube is closed. Next, the user rests upon the cushion A in the posture he would assume when normally using it. This deflects some of the air cells 4 toward the base 2 or at least drives the dome-shaped ends 56 toward the base 2. Usually most of the air cells 4 are distorted somewhat, but some more than others. Even so, the interiors of all of the air cells exist at the same pressure. Once upon the cushion A, the user opens the air valve 8 slightly and allows some of the air to escape, and as a consequence the user sinks deeper into the array of air cells 4. The air valve 8, however, is closed before any of the air cells 4 bottom out. Indeed, when the valve 8 is closed, at least one inch of space should exist between the base 2 and the dome-shaped ends 56 of the air cells 4 having the greatest deflection. By sinking still further into the array of air cells 4, the limit being when at least one of the cells 4 bottoms out, the support provided by the air cells 4 is distributed over a greater area on the supported body, and thus decreases in terms of force per unit area. Of course, the supporting force is substantially equal when considered on a unit area basis, even though some air cells are deflected more than others, this being by reason of the fact that all of the air cells 4 are in communication through the base 2 and therefore exist at the same pressure.

To provide greater continuity to the supporting surface provided by the dome-shaped ends 56 of the air cells 4, the cushion A may be contained in a cover 60 (FIG. 1) that surrounds the array of cells 4 on the cushion A. The cover 60 further protects the air cells 4 and confines the air cells 4 of the outer rows so that they exhibit less tendency to deflect outwardly.

The cover 60, which is optional, includes retaining section 62 which lies beneath the base 2 of the cushion A and covering section 64 which is attached to the retaining section 60 and extends around and over the array of air cells 4.

The retaining section 62 is cut from a fabric that has little, if any, elasticity. It contains a large open area through which the base 2 is exposed, but it is continuous along the periphery of the base 2 with which its margins register, except that its corners are cut off, leaving beveled edges 66 beyond which the corners of the base 2 project. The covering section 64 is cut from an elastic fabric that stretches in both of the directions that the fabric thread passes. It is connected to the retaining section 62 along stitching 68 at the periphery of the retaining section 62, except that the stitching 68 does not extend along the beveled edges 66. Thus, the covering section 64 is detached from the retaining section 62 at the beveled edges 66, leaving slits through which the corners of the base 2 project. The slit at one of the corners further accommodates the filling tube 6. In its corner regions the covering section 64 is provided with vertical stitches 70 which are about as long as the air cells 4 are high. These enable the covering section 64 to fit snugly over and around the array of air cells 4 without gathering at the corners of the array. Since the covering section 64 has two-way stretch characteristics, it yields to conform to the contours of the body supported on the air cells 4, all without imposing shear or other restoring stresses of any significance. The retaining section 62, being located beneath the base 2 of the cushion A, keeps the covering section 64 in place over and around the array of air cells 4.

The communicating strips 30 need not be separate elements of the base 2, but instead they may be formed integral with either the upper sheet 26 or the lower sheet 28. Irrespective of whether they are integral or separate, the strips 30 may be arranged such that some cells 4 are totally isolated from other cells 4 and of course must be inflated through a different filling tube 6. This divides the cushion A into separate compartments or sections, which in turn may be used to position the user or counteract certain external forces applied to the user. For example, when the cushion A is used for the driver's seat of an automotive vehicle, such as a truck, its air cells 4 may be arranged in sections so that the cells 4 along the sides of the cushion are capable of being inflated to a greater pressure and height than the ones at the center of the cushion A. This positions the user over the center section and enables the side sections to resist forces caused by the acceleration encountered in cornering. Of course, when the cushion A contains several independent sections, each must be adjusted to acquire the desired immersion depth.

The pyramidal base 2 and its sloping surfaces are present primarily to eliminate deep pockets in the form 34 on which the air cells 4 are produced, for deep pockets, particularly when presented downwardly tend to trap air along the mandrels 38 and the resulting air bubbles cause discontinuities in the latex coating that covers the mandrels 38. Where dipping with the plate 36 at 45° is employed, all of the inclined surfaces may be eliminated except the one that is presented downwardly on the mandrel 38 when the form 34 is dipped. In that case, the resulting air cell 4 has only one sloping surface at its pedestal 10, and most of the side walls 14 for the fins 12 rise directly from the upper sheet 26.

Figure 10:
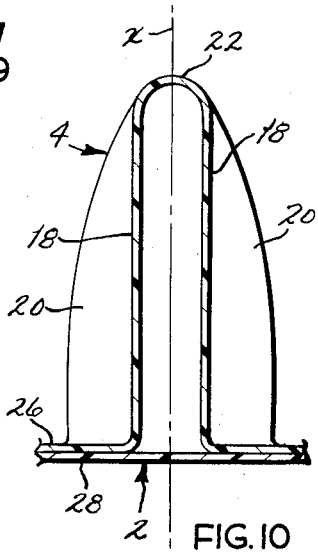
FIG. 10 is a sectional view of an air cell similar to FIG. 5, but without a pedestal.

The air cells 4 may also be formed in a cavity mold, in which case the pedestal 10 may be eliminated altogether (FIG. 10). Thus, the side walls 14 for all of the fins 12 would rise directly from the upper sheet 26 of the base 2, as would the concave connecting walls 18. Rotational molding and injection molding may be used to form the air cells 4 without pedestals 10, both of these processes using cavity molds.

This invention is intended to cover all changes and modifications of the example of the invention herein chosen for purposes of the disclosure which do not constitute departures from the spirit and scope of the invention.

What is claimed is:

1. An inflatable cushion comprising: a flexible rectangular base formed from a flexible material and having corners; air cells attached to and projecting outwardly from the base to form an array, with the air cells likewise being formed from a flexible material, the interiors of the air cells further being in communication through the base for equalizing the pressure within the air cells, each air cell when deflated having four laterally directed projections with each projection having closely spaced side walls, the side walls of adjacent projections being connected near the center of the air cell to form depressions in the sides of the air cell, the air cells being arranged on the base in an array with the depressions of adjacent air cells facing each other, the air cells when the pressure within them is increased being adapted to expand such that the side walls of their projections move outwardly away from their centers and thereby eliminate the depressions and such that the side walls along opposing depressions in adjacent air cells are adapted to come into contact; and a cover including a retaining section that underlies the base and a covering section that is attached to the retaining section and extends over and around the array of air cells, the covering section being formed from an elastic fabric, the corners of the rectangular base being projected through the cover.

2. An inflatable cushion comprising: a flexible base containing connecting channels; and inflatable fluid cells attached to and projecting outwardly away from the base to form an array of fluid cells, the connecting channels of the base opening into the interiors of the fluid cells for generally equalizing the pressure within the fluid cells, each fluid cell having a center axis about which it is symmetrical and when deflated having a pedestal at which the fluid cell is connected to the base, with the pedestal being of rectangular shape and enclosing a generally, rectangular opening that leads from the base into the interior of the cell, each fluid cell when deflated further having four fins which project away from the base and also extend laterally away from the center of axis of the cell toward the corners of the pedestal, but do not extend beyond the pedestal so that the fluid cell is widest at its pedestal when deflated, each fin having a pair of closely spaced side walls which are connected along an edge that generally aligns with the corners of the pedestal, the side walls of adjacent fins being further connected to each other near the center axis of the fluid cells to form depressions in the sides of the fluid cell, the dimension of the fluid cell along its center axis being greater than the width of the fluid cell at its pedestal, the fluid cells being arranged in the array with the depressions of adjacent fluid cells facing each other, so that when the pressure within the fluid cells is increased the side walls of the fins on each fluid cell move outwardly away from the center axis for the cell to eliminate the depressions in the fluid cells and the side walls of adjacent fluid cells come into face-to-face contact.

3. A cushion according to claim 2 wherein each fluid cell when deflated has four pedestal walls that are located between the depressions and the base and are inclined with respect to the base to form the pedestal on the base, the pedestal walls also being adapted to move outwardly away from the center axis of the fluid cell when the pressure within the fluid cell is increased.

4. A cushion according to claim 2 wherein the edges of the fins for each fluid cell curve toward the center axis of the fluid cell remote from the base when the fluid cell is deflated.

5. A cushion according to claim 2 wherein each fluid cell includes an end wall and the curved edges of the fins merge into the end wall.

6. A cushion according to claim 2 wherein the fluid cells are arranged in the array on closely spaced rows, each fluid cell being in two rows with the one row being perpendicular to the other row.

7. A cushion according to claim 2 wherein the pedestals of the fluid cells form a square opening into the base.

8. A cushion according to claim 2 wherein the pedestals of each fluid cell have walls that are inclined with respect to the center axis of the cell such that the pedestal possesses a generally pyramidal configuration.

9. A cushion according to claim 8 wherein the inclined walls of the pedestal for each fluid cell lie between the depressions for that fluid cell and the base.

10. A cushion according to claim 2 wherein the fluid cells are arranged in horizontal and transverse rows, and the fluid cells are oriented such that the margins of the rectangular openings at the pedestals are parallel to the rows.

11. A cushion according to claim 2 wherein the depressions for each fluid cell are located beyond the pedestal for that fluid cell and the fins for the cell are attached to the pedestal.

12. An inflatable cushion comprising: a first flexible sheet; a second flexible sheet attached to the first sheets and having rectangular openings arranged in longitudinal and transverse rows with the margins of the openings being parallel to such rows, the first and second sheets being joined together along their peripheries such that an impervious seal exists in the region of the peripheries, the sheets also being joined together within the confines of the peripheries so that the sheets cannot be significantly separated in that region, yet such that the openings are connected by channels that are essentially between the two sheets, whereby the openings are in communication with each other; and flexible fluid cells attached to the second sheet around the rectangular openings therein and projecting away from the second sheet, each fluid cell having a center axis and when deflated including four fins which extend outwardly away from the center axis toward the corners of the opening at which the cell is located, with each fin having a pair of closely spaced walls which merge at an edge, the edges of the fins aligning with the corners of the opening and extending away from the opening where the edges converge, so that the fins extend no further laterally than the opening for the fluid cell on which they are located, the dimension of each fluid cell along its center axis being greater than the width of the rectangular opening around which the fluid cell is attached to the second sheet, the side walls of adjacent fins on each fluid cell further being connected to each other near the center axis for the cell to form depression in the sides of the fluid cell, whereby the depressions of any fluid cell will open toward the depressions in cells that are adjacent to that cell, the fluid cells when the pressure within them is increased being adapted to expand such that the side walls of their fins move outwardly away from the center axes of the cells to eliminate the depressions in the cells, all such that the side walls at opposing depressions of adjacent fluid cells come into contact.

13. The cushion according to claim 12 wherein the fins of each fluid cell at their upper ends curve inwardly toward the axis of the fluid cell.

14. The cushion according to claim 12 wherein the fluid cells are formed integral with the second sheet.

15. The cushion according to claim 12 wherein when the fluid cells are inflated, the side walls of the fluid cells will expand outwardly between the fins so that the fins are less pronounced and the side walls of adjacent fluid cells will contact each other and the upper ends of the fluid cells will provide a supporting surface.

16. A cushion according to claim 12 wherein each fluid cell when deflated further includes a pedestal which is attached to the second sheet around the opening in the second sheet at which the fluid cell is located, and the fins for the fluid cell are attached to and extend away from the pedestal.

17. A cushion according to claim 16 wherein the pedestal has at the ends of the depressions in the sides of its fluid cell inclined walls that slope toward the second sheet such that the pedestal has a generally pyramidal configuration.

18. A cushion according to claim 12 wherein the outside edges of the fins for each deflated fluid cell converge to a dome on the deflated fluid cell.

19. A cushion according to claim 12 wherein the openings in the second sheet are square.

* * * * *